United States Patent [19]

Couput

[11] Patent Number: 4,546,892

[45] Date of Patent: Oct. 15, 1985

[54] PLASTIC SEALING SCREW CAP WITH IMPROVED TAMPER-PROOF STRIP

[75] Inventor: Francis Couput, Bizanos, France

[73] Assignee: Cebal, Clichy, France

[21] Appl. No.: 567,867

[22] PCT Filed: Apr. 19, 1983

[86] PCT No.: PCT/FR83/00072

§ 371 Date: Dec. 13, 1983

§ 102(e) Date: Dec. 13, 1983

[87] PCT Pub. No.: WO83/03809

PCT Pub. Date: Nov. 10, 1983

[30] Foreign Application Priority Data

Apr. 23, 1982 [FR] France ..... 82 07467
Mar. 7, 1983 [FR] France ..... 83 04093

[51] Int. Cl.[4] ..... B65D 41/34

[52] U.S. Cl. ..... 215/252; 215/253; 215/317

[58] Field of Search ..... 215/252, 253, 258, 317

[56] References Cited

U.S. PATENT DOCUMENTS 3,072,277 1/1963 Hoffmann ..... 215/253
4,196,818 4/1980 Brownbill ..... 215/252
4,322,012 3/1982 Conti ..... 215/252 X

FOREIGN PATENT DOCUMENTS 0049876 4/1982 European Pat. Off. ..... 215/252
1092793 11/1960 Fed. Rep. of Germany ..... 215/317
2033350 5/1980 United Kingdom ..... 215/252

*Primary Examiner*—Steven M. Pollard
*Attorney, Agent, or Firm*—Oblon, Fisher, Spivak, McClelland & Maier

[57] ABSTRACT

The invention relates to a plastic sealing screw cap with an improved tamper-proof strip, intended for containers provided with a ring of the "Pilferproof" type having a threading above a counter-ring whose lower part forms a raised edge, the cap having a head, a skirt provided with an inner threading, and a tamper-proof strip connected to the lower part of the skirt by a multiplicity of bridges constituting connections that can be broken. The tamper-proof strip has two parts, a first annular part (4A) connected to the lower part of the skirt (2) by the bridges that can be broken (5) and a second part consisting of a multiplicity of tabs (6) connected to the first part (4A) by thinner areas (7) forming a hinge, each tab having a heel (8) and a thinner extension (9). The tabs (6) form with the annular part (4A) an acute angle having its apex on the thinner areas (7) and are turned to the inside of the cap. Sealing means are explained.

10 Claims, 7 Drawing Figures

PLASTIC SEALING SCREW CAP WITH IMPROVED TAMPER-PROOF STRIP

FIELD OF THE INVENTION

The invention relates to a plastic sealing screw cap with an improved tamper-proof strip. It is related to the technical field of packaging elements.

BACKGROUND OF THE INVENTION

Numerous sealing screw devices having a safety means intended to control access to the contents are known of the container closed by these devices, and to prevent, in particular, fraudulent handling of these contents.

Generally, these sealing devices which are fitted on bottles whose rings are of the almost universally standardized type known under the name "Pilferproof" have a screw cap, possibly provided with a seal, and an annular safety strip that can be separated at the lower part from the skirt of the cap. Any attempt to unscrew the cap must cause the separation of the safety strip.

Originally, these tamper-proof caps were made of metal, particularly aluminum and, after screwing on the cap, the safety strip was crimped on the neck by a simple mechanical device.

At the present time, there is a tendency to replace aluminum with thermoplastic polymers which are no longer suited to a simple crimping because of their natural elasticity, Therefore, a certain number of solutions have been devised to provide a crimping of the tamper-proof strip.

In French Pat. Nos. 2,282,378 and 2,467,790, heat-shrinking of the tamper-proof strip under the action of the jet of hot air is performed.

This solution involves adding an additional stage to the bottling and capping lines, and exhibits the risk of total melting of the seals when the line stops, which necessitates providing a safety device. Further, the appearance of the shrunken strip often leaves something to be desired.

In French Pat. No. 2,349,140, the tamper-proof strip is folded toward the inside of the cap when it is screwed on the neck of a bottle, so that its upper edge strikes against a projection of the neck. During unscrewing, the strip thus locked cannot rise and is separated from the skirt. But there is a danger that the strip will be pulled out without separating.

SUMMARY OF THE INVENTION

This invention constitutes another solution of this problem, a solution which provides both an easy fitting of the cap and a clean and reliable separation of the tamper-proof strip during the first unscrewing.

Particular means for sealing the cap are proposed.

BRIEF DESCRIPTION OF THE DRAWINGS

FIG. 3 also represents a first means for sealing the cap of the invention.

DETAILED DESCRIPTION OF THE PRESENTLY PREFERRED EMBODIMENTS

Figure 1:
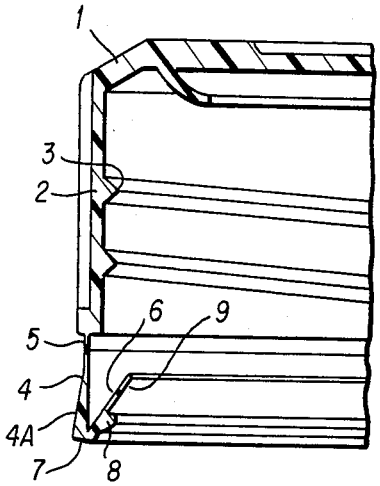
FIGS. 1 to 4 represent in section (FIGS. 1 and 2) or in partial section (FIGS. 3 and 4) the cap, the object of the invention.

The sealing screw cap of the invention has (FIG. 1) a head (1) and a skirt (2) provided with an inner threading (3) which works with the threading of the container to be sealed. At the lower part of the skirt (2) the tamper-proof strip (4) is fastened by a multiplicity of bridges (5) which constitute the breaking points during subsequent unscrewing. The tamper-proof strip (4) has a continuous annular upper part (4A) and a lower part consisting of a multiplicity of tabs such as (6) connected to the upper part (4A) by a thinner part (7) which constitutes a sort of hinge. The tabs (6) comprise a heel (8) and a thinner extension (9).

Figure 2:
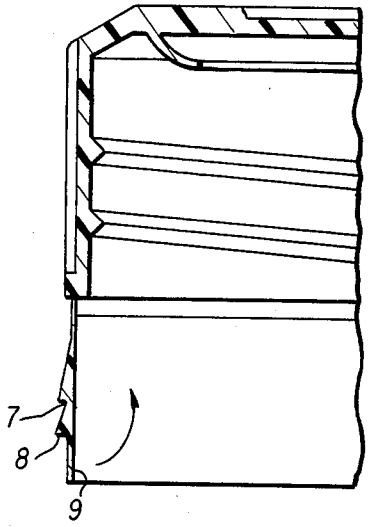

The tabs (6) are molded in the position of FIG. 1, i.e., turned upward. During removal from the mold, they turn and come into the vertical position as in FIG. 2. Once removal from the mold is completed, their own elasticity brings them into the position of FIG. 1, after pivoting around the thinner area (7) which acts as a hinge. Thus they form an acute angle with the annular part (4) and are turned toward the inside of the cap.

Figure 3:
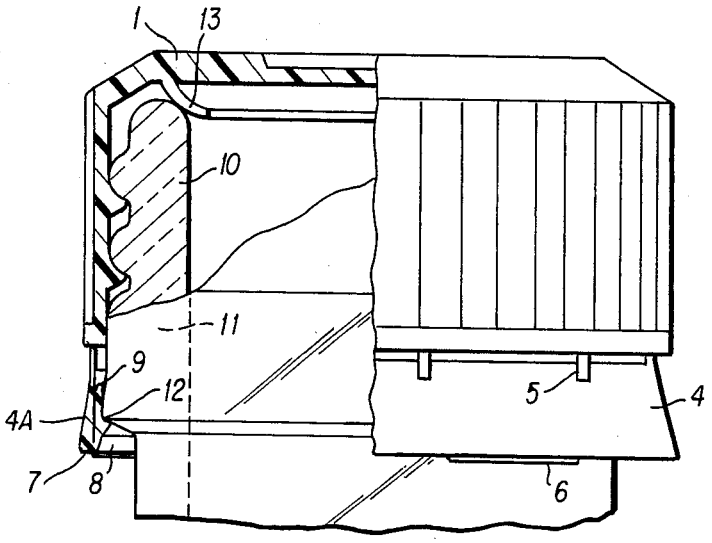
Figure 4:
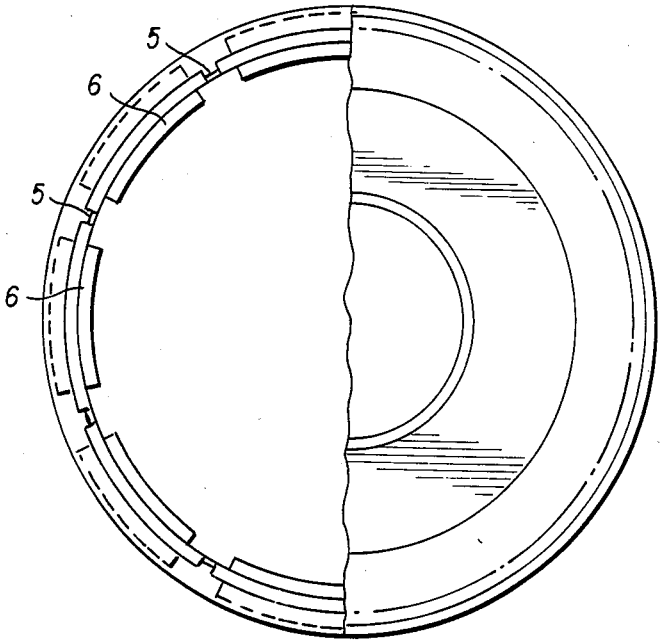

During the screwing of the cap over the glass ring (10) (FIGS. 3 and 4), the tabs (6) are forced by the counter-ring (11) of the neck to fold against the strip (4) and, at the end of screwing, the heels (8) go beyond the edge (12) of the counter-ring (11) (FIG. 3). The elastic memory of the tabs (6) then flattens the thinner extension (9) over the counter-ring (11) in such a position that any attempt at unscrewing causes the heels (8) to strike under the edge (12) of the counter-ring (11). The thinner extension (9) of the tab (6) being wedged between the strip (4A) and the counter-ring (11), the heels (8) cannot be disengaged downward, and the breaking of the bridges (5) is then inevitable, which leaves visible proof of this first opening of the cap.

This plastic sealing screw cap with an improved tamper-proof strip has, with this tamper-proof device, sealing means which, separately or in combination, constitute advantageous improvements of the cap.

A first sealing means is an inner lid (13) in the shape of a slanted peripheral lip (FIG. 3) whose outer surface is applied over the interior of the rounding of the end of the neck of the bottle during sealing by screwing on the cap.

Figure 5:
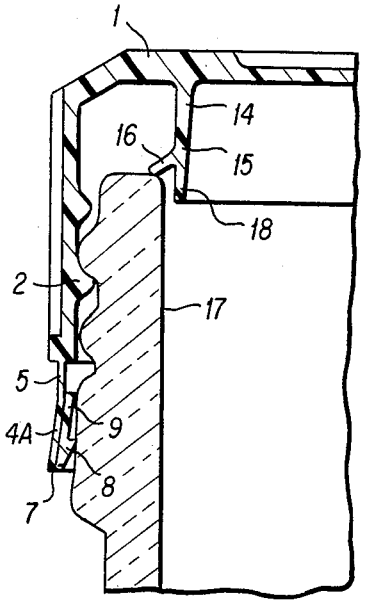
FIGS. 5 and 6 represent, in axial half-section, a second sealing means.

A second sealing means (FIGS. 5 and 6) is particularly effective; it makes the seal on the inside of the neck a little lower than its opening thanks to a lid (14) connected to the head (1), this lid (14) being formed by a central sleeve in the shape of a skirt (15) flanked by a peripheral side lip (16). The outside diameter of the body of the central sleeve in the shape of a skirt (15) is slightly smaller than the minimum diameter provided for the inside (17) of the neck, the terms minimum and maximum meaning generally acknowledged limits for the inside diameter (17) because of the variations inherent in the industrial processes of bottle manufacturing. The outside diameter of the peripheral side lip (16) is slightly larger than the maximum provided for the inside (17), so that the end of the peripheral side lip (16) first strikes against the upper end of the neck when the cap is screwed on.

By way of example and to clarify the ideas, in the case of a neck with an inside diameter (17) in industrial practice between 16.7 mm and 19 mm, the sleeve (15) has an outside diameter of 16.3 mm and its peripheral lip (16) has an outside diameter of 19.5 mm.

Figure 6:
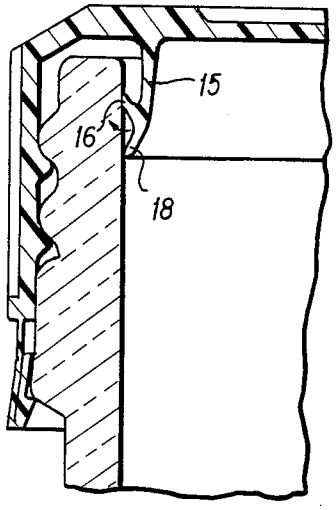

During the screwing on of the cap, the lower part (18) of the sleeve penetrates with a slight play until the peripheral side lip (16) strikes against the edge of the neck (FIG. 5), then when the screwing is continued, the peripheral side lip (16) enters into the neck by swinging upward (FIG. 6), this swinging causing a flaring of the lower part (18) of the sleeve in the shape of a skirt (15), this lower part (18) then being applied lower on the inner surface of the neck. Thus, there is obtained a double sealing by the ends of the peripheral side lip (16) and the lower part (18). As can be seen in FIG. 6, this effect of swinging and flaring is reflected in each axial section of the lid by a rotation and a bending diagrammed by the arrow. In the case of a container containing a liquid under pressure, the inner pressure tends to apply the lower part (18) of the sleeve more against the inner wall of the neck, and the end of the peripheral side lip (16) continues to perform a second sealing, its application against the wall being due to its swinging and to its elasticity. The peripheral side lip (16) is preferably directed downward (FIG. 5), so as to emphasize this effect of swinging and elastic support.

Figure 7:
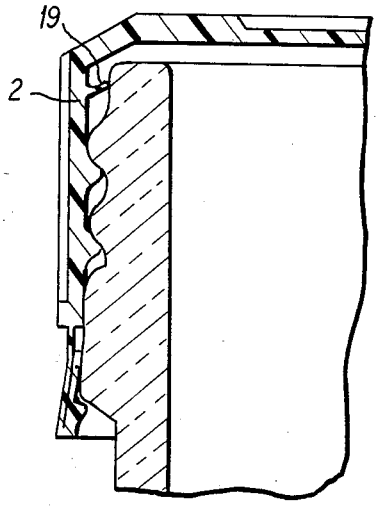
FIG. 7 represents, in axial half-section, a third sealing means.

A third sealing means (FIG. 7) performs the sealing on the area of the external surface of the neck between the rounding of the end of this neck and the beginning of the threading. A peripheral lip (19) connected to the skirt (2) of the cap above its threading extends inward so that it is applied rather strongly over the outer wall of the neck, in the area between the rounding of the end and the threading, an area whose diameter tolerances are quite narrow, when the cap is screwed on. When the cap is screwed on, the end of the peripheral lip (19) rests against the outer wall of the neck and turns upward by being applied elastically. The peripheral lip (19) at rest is directed preferably downward so as to increase this elastic effect or spring effect. The advantage of the location of this peripheral lip constituting the third sealing means is the good reproducibility of the quality of the sealing obtained linked with the narrow diameter tolerances of the application area.

The sealing screw cap of the invention, provided with sealing means and in particular with any one of the three means explained above or with a combination of any of these means is easily made by molding of a thermoplastic polymer such as polypropylene. Its tamper-proof device offers a total reliability and adapts completely to all the automatic bottling and capping lines. The cap of the invention fits on the containers without detracting from their esthetic quality.

I claim:

1. A plastic sealing cap with an improved tamper-proof strip, said cap being adapted for use on a container having an opening in a neck on the external peripheral surface of which is a counter-ring having an inwardly extending shoulder facing away from the opening of the container, said cap comprising:

(a) a head which fits over the opening of the container;

(b) a first annular skirt which extends from said head and which fits over the neck of the container; and (c) an annular tamper-proof strip connected to said first annular skirt by a plurality of bridges which are sized and shaped so as to be broken when the cap is removed from the container, said annular tamper-proof strip comprising:

(i) a first annular part connected to said plurality of bridges and (ii) a plurality of tabs connected to and projecting inwardly from said first annular part toward the opening of the container, each of said tabs comprising a heel which is sized, shaped, and positioned to abut against the inwardly extending shoulder on the counter-ring and a thinner extension which is sized, shaped, and positioned to be wedged between said first annular part and the external surface of the counter-ring.

2. A plastic sealing cap as recited in claim 1 further adapted for use with a container having external threads on the neck between the opening and the counter ring, said cap having internal threads in said first annular skirt sized, shaped, and positioned to engage the external threads on the neck of the container.

3. A plastic sealing cap as recited in claim 1 wherein each of said tabs is connected to said first annular part by a thinner part forming a hinge.

4. A plastic sealing cap as recited in claim 3 wherein each of said thinner parts forming a hinge resiliently biases the associated one of said tabs inwardly.

5. A plastic sealing cap as recited in claim 1 wherein said first annular skirt and said annular taper-proof strip are symmetrical about the axis of the opening.

6. A plastic sealing cap is recited in claim 1 and further comprising a sealing means in the form of an inner lid in the shape of a slanted peripheral skirt which makes resilient annular engagement with the neck of the container surrounding the opening.

7. A plastic sealing cap as recited in claim 1 and further comprising a sealing means in the form of a central sleeve which is received in the opening in the neck of the container, said central sleeve comprising:

(a) a second annular skirt projecting from said head inwardly of said first annular skirt and inwardly of the inner surface of the opening in the neck of the container;

(b) a lower lip which projects from said second annular skirt inwardly of the opening in the neck of the container; and (c) a peripheral side lip which projects outwardly from said second annular skirt, said peripheral side lip being sized, shaped, and positioned to engage the neck of the container as the cap is moved into position on the neck and to be forced backwardly against its inherent resiliency as the cap continues to move into position on the neck of the container, thereby providing a first annular seal between said peripheral side lip and the inner surface of the opening in the neck of the container, while at the same time forcing said lower lip upwardly against its inherent resiliency, thereby providing a second annular seal between said peripheral side lip and the inner surface of the opening in the neck of the container.

8. A plastic sealing cap as recited in claim 1 and further comprising a sealing means in the form of a skirt flanked by a peripheral side lip, the outside dimensions of said skirt being slightly smaller than the minimum dimensions of the inside of the neck of the container and the outer dimensions of said peripheral side lip being slightly larger than the maximum dimensions of the inside of the neck of the container.

9. A plastic sealing cap is recited in claim 1 and further comprising a sealing means in the form of an annular peripheral lip extending inwardly from said first annular skirt so as to resiliently engage the external surface of the next of the container.

10. A plastic sealing cap as recited in claim 9 wherein said annular peripheral lip is sized, shaped, and positioned so as to be forced backwardly against its inherent resiliency as the cap is moved into position on the neck of the container.

* * * * *